US008858204B2

(12) United States Patent
Crochet

(10) Patent No.: US 8,858,204 B2
(45) Date of Patent: Oct. 14, 2014

(54) DRY VACUUM PUMP HAVING MULTIPLE LUBRICANT RESERVOIRS

(75) Inventor: Stephane Crochet, Rumilly (FR)

(73) Assignee: Adixen Vacuum Products, Annecy (FR)

( * ) Notice: Subject to any disclaimer, the term of this patent is extended or adjusted under 35 U.S.C. 154(b) by 656 days.

(21) Appl. No.: 13/170,174

(22) Filed: Jun. 27, 2011

(65) Prior Publication Data

US 2012/0003105 A1 Jan. 5, 2012

(30) Foreign Application Priority Data

Jun. 30, 2010 (FR) ..... 10 02756

(51) Int. Cl.

| | |
|---|---|
| ***F01C 21/04*** | (2006.01) |
| ***F03C 2/00*** | (2006.01) |
| ***F03C 4/00*** | (2006.01) |
| ***F04C 2/00*** | (2006.01) |
| ***F04C 29/02*** | (2006.01) |
| ***F04C 25/02*** | (2006.01) |
| ***F04C 27/00*** | (2006.01) |
| ***F01C 19/00*** | (2006.01) |
| *F04C 18/12* | (2006.01) |

(52) U.S. Cl.

CPC ..... *F04C 25/02* (2013.01); *F04C 18/12* (2013.01); *F04C 29/028* (2013.01); *F04C 2240/809* (2013.01); *F04C 29/021* (2013.01); *F04C 27/009* (2013.01); *F04C 2220/12* (2013.01); *F01C 19/005* (2013.01); *Y10S 418/01* (2013.01)

USPC ..... 418/83; 418/96; 418/98; 418/102; 418/270; 418/DIG. 1

(58) Field of Classification Search

CPC ..... F01C 19/005; F04C 25/02; F04C 27/009; F04C 29/02; F04C 29/021; F04C 29/026; F04C 29/028; F04C 29/04; F04C 18/12; F04C 2220/12; F04C 2240/809

USPC ..... 418/83–85, 96–98, 102, 206.7, 270, 418/DIG. 1

See application file for complete search history.

(56) References Cited

U.S. PATENT DOCUMENTS 1,696,882 A * 12/1928 Hassler ..... 418/95
4,632,650 A * 12/1986 Frieden et al. ..... 418/96

(Continued)

FOREIGN PATENT DOCUMENTS

DE 1939717 A1 * 2/1971 ..... F04C 29/02
DE 19736017 A1 2/1999
DE 19820523 A1 11/1999
EP 1975410 A1 10/2008

(Continued)

OTHER PUBLICATIONS

French Search Report for FR1002756 dated Feb. 14, 2011 with partial English translation.

*Primary Examiner* — Theresa Trieu
(74) *Attorney, Agent, or Firm* — Sughrue Mion, PLLC

(57) ABSTRACT

A vacuum pump includes a pumping stage, a rotary shaft supported by a lubricated support bearing; a lubricant deflector mounted between the lubricated support bearing and a ring seal which is mounted on the rotary shaft between the lubricant deflector and the pumping stage, a first reservoir containing a first reserve of liquid lubricant and in communication with the lubricated support bearing in a first volume, a lubricant splashing unit mounted on the rotary shaft in the first reservoir and having one end bathed in the first reserve of lubricant. A second reservoir includes a second reserve of liquid lubricant separated from the first reservoir by a separation wall having an aperture through which the first and second reserves of lubricant communicate. A lubricant return channel having one inlet facing the lubricant deflector opens into the second volume of the second reservoir above the second reserve of lubricant.

8 Claims, 3 Drawing Sheets

(56) References Cited

U.S. PATENT DOCUMENTS

| | | | | |
|---|---|---|---|---|
| 4,830,590 | A * | 5/1989 | Sumikawa et al. | 418/96 |
| 5,044,895 | A | 9/1991 | Frieden et al. | |
| 2010/0189583 | A1 | 7/2010 | Cacard et al. | |

FOREIGN PATENT DOCUMENTS

| | | | |
|---|---|---|---|
| FR | 2920207 | A1 | 2/2009 |
| JP | 3130592 | A | 6/1991 |
| WO | 2008/142437 | A1 | 11/2008 |

* cited by examiner

DRY VACUUM PUMP HAVING MULTIPLE LUBRICANT RESERVOIRS

BACKGROUND OF THE INVENTION

1. Field of the Invention

The present invention pertains to a dry type vacuum pump comprising a device for sealing against lubricants mounted between a lubricated support bearing and a pumping stage. The invention can be applied especially to a Roots or claw dry type vacuum pump comprising two rotary lobed shafts or again a spiral type or screw type pump or a pump working on another similar principle.

These pumps generally comprise one or more series-mounted pumping stages in which a gas to be pumped flows between an admission intake and a delivery outlet. Prior-art vacuum pumps include rotary lobe pumps known as bi-lobe or tri-lobe Roots pumps and double claw pumps also known as "claw" pumps.

A rotary lobe pump comprises two rotors of identical profiles rotating in opposite directions inside a stator. During rotation, the gas to be pumped is trapped in the free space contained between the rotors and the stator, and is driven by the rotor to the following stage or after the first stage to the delivery outlet. The operation takes place without any mechanical contact between the rotors and the stator, thus making it possible to have total absence of oil in the pumping stages.

The rotors are borne by the rotary shafts supported by lubricated support bearings of a shaft-end-mounted motor drive compartment. This motor drive compartment is isolated from the pumping stages by a device for sealing against lubricants through which the rotary shafts are always liable to rotate.

During operation, the rotating of the shafts in the lubricated support bearings gives rise to a lubricant mist which, when it undergoes pressure variations, risks migrating toward the pumping stages. Now, it is indispensible that no trace of oil or grease should be found at the pumping stages for applications known as "dry" operations such as semiconductor substrate manufacturing methods.

2. Description of the Prior Art

There already exist devices in the prior art for sealing against lubricants comprising a lubricant deflector or baffle and a frictional ring seal known as a lip seal. The lubricant deflector is mounted on the rotary shaft between the lubricated support bearings and the frictional ring seal and rotates connectedly with the rotary shaft during operation. The deflector deflects the lubricant by the effect of centrifugal force and sends it to the bottom of the motor drive compartment through a small pipe, the inlet of which is positioned facing the end of the lubricant deflector and the outlet of which opens into the bottom of the motor drive compartment. This device keeps the lubricant confined within the motor drive compartment. The frictional ring seal forms a second security element if lubricant residues should nonetheless pass through the lubricant deflector. However, this safety measure could prove to be inadequate. The intensification of production output rates is leading to increased operating temperatures for vacuum pumps, and this can make the frictional ring seal more brittle. Furthermore, the increase in the repetition of pressure variations on either side of the frictional ring seal, which can be associated with corrosiveness in the lubricant that has gone through the lubricant deflector, can cause a premature wearing out of the frictional ring seal and require servicing at closer intervals, each intervention involving the stoppage of the semiconductor manufacturing installations and stoppage of the vacuum pump, and this is very costly.

SUMMARY OF THE INVENTION

It is one of the aims of the present invention to propose a dry type vacuum pump comprising a lubricant-sealing device, mounted between a lubricated support bearing and a pumping stage, the service life of which is increased.

To this end, an object of the invention is a dry-type vacuum pump comprising:

- at least one pumping stage,
- at least one rotary shaft supported by a lubricated support bearing,
- at least one lubricant deflector and one ring seal mounted on the rotary shaft, the ring seal being mounted between the lubricant deflector and the pumping stage, the lubricant deflector being mounted between the lubricated support bearing and the ring seal,
- a first reservoir containing a first reserve of liquid lubricant, the first reserve being in communication with the lubricated support bearing in a first volume,
- a lubricant splashing unit mounted on the rotary shaft in the first reservoir, one end of the lubricant splashing unit being bathed in the first reserve of liquid lubricant.

The vacuum pump has a second reservoir comprising a second reserve of liquid lubricant, the second reservoir being separated from the first reservoir by a separation wall having a communication aperture that puts the first and the second reserves of liquid lubricant into communication. A lubricant return channel having one inlet situated so as to be facing said lubricant deflector opens into the second volume of the second reservoir above the second reserve of liquid lubricant.

During operation, the first volume containing the first lubricated support bearing and the lubricant splashing unit has an internal misty atmosphere comprising a mixture of gas and lubricant, created especially by the rotation of the lubricant splashing unit, that enables the roller bearings of the vacuum pump to be lubricated. This atmosphere is separated by the separation wall from the atmosphere of the second reservoir into which the lubricant return channel leads. Since the second reservoir contains no lubricant splashing unit, nor any other rotational element in motion during the operation of the vacuum pump, it has a calm gas atmosphere above the liquid lubricant without any lubricant mist, the liquid phases and the gas phases being well separated from each other.

Thus, when the lubricant mist is drawn from the lubricated support bearing to the pumping stage, the lubricant is deflected by the lubricant deflector into the lubricant return channel through the effect of centrifugal force until it gets poured into the reserve of liquid lubricant of the second isolated reservoir. Then, during the pressure-balancing phases when the pressure of the lubricated support bearing is greater than the pressure of the pumping stage, the lubricant that has fallen to the bottom of the reservoir into the second reserve of lubricant, at a level lower than that of the opening of the lubricant return channel, cannot rise in this channel. On the contrary, "dry" gas, i.e. lubricant-free gas, situated in the second reservoir above the level of lubricant liquid, will fill the lubricant return channel and restore the balancing of the pressures on either side of the sealing device. The separation of the second reservoir thus prevents the misty lubricant air contained in the oily environment of the lubricated support bearing in operation from entering the lubricant return channel.

The second reservoir and said lubricant return channel are for example made in the casing of a motor drive compartment of said vacuum pump.

The conductance of the passage of the shaft in said separation wall and the conductance at the opening of the lubricant return channel are calibrated to direct a gas stream in the lubricant return channel from the second volume to the lubricant deflector.

With this calibration of the conductance values, when the pressure drops in the pumping stage, it drops more quickly in the first volume comprising the lubricated support bearing than in the second volume in the isolated second reservoir. The second volume then preserves a slight excess pressure relatively to the first volume. The dry gas will then rush through the lubricant return channel and get accelerated therein up to the inlet of the lubricant return channel thus forming a barrier of dry gas at the lubricant deflector. This process encourages an acceleration of the gas stream in the lubricant return channel from the second volume to the lubricant deflector rather than from the first volume to the second volume.

It is provided for example that the gap between the diameter of the shaft passage in the separation wall and the diameter of the rotary shaft will be smaller than three millimeters, preferably of the order of 2 millimeters. And it also can be provided that the size of the internal diameter of the opening of the lubricant return channel will be smaller than 5 millimeters, preferably of the order of 4 millimeters.

An annular groove can be made in the casing in front of a peripheral end of the lubricant deflector, said annular groove communicating with the inlet of said lubricant return channel.

According to one embodiment, the vacuum pump has two rotary shafts supported by a respective lubricated support bearing. Said lubricant return channel can then comprise a first channel portion associated with a first lubricated support bearing, a second channel portion associated with a second lubricant support bearing and a channel portion common to said first and second channel portions in order to preserve an equilibrium of lubricant on the two lubricated support bearings.

For example, the lubricant return channel has a communicating groove between said first channel portion and said second channel portion and said lubricant return channel comprises a connection element that gets joined with said communicating groove and opens into a junction tube. Said connection element may comprise a plate closing said communicating groove and an off-centered junction tube projecting perpendicularly from said plate.

BRIEF DESCRIPTION OF THE DRAWINGS

Other features and characteristics of the invention shall appear from the following description, given by way of an example, without any exhaustive character, made with reference to the appended drawings of which.

In these figures, the identical elements bear the same reference numbers.

MORE DETAILED DESCRIPTION

Figure 1:
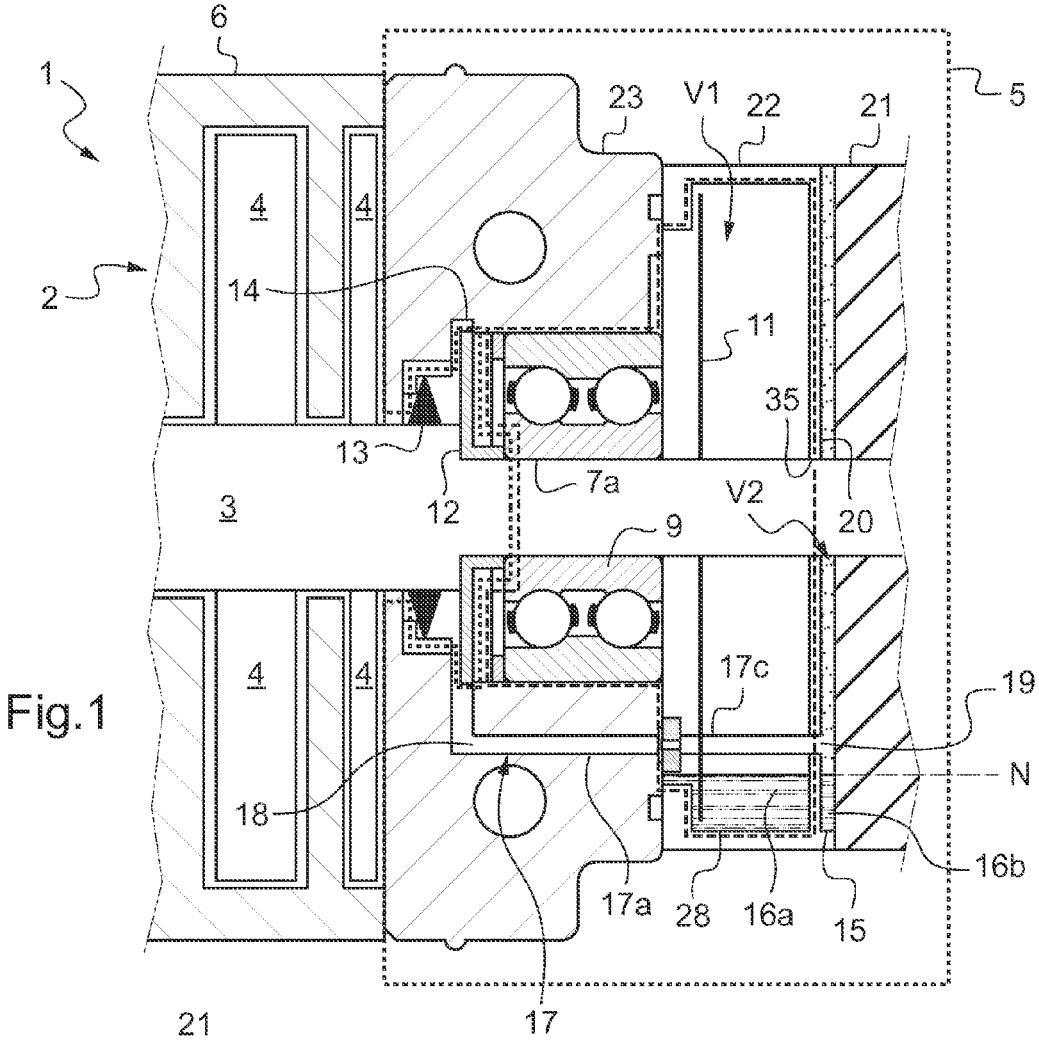
FIG. 1 is a view in longitudinal section of a part of a vacuum pump.

FIGS. 1 to 6 illustrate an exemplary embodiment of a dry type vacuum pump having two Roots type rotary lobe shaft. Naturally, the invention can also be applied to other types of dry-type vacuum pumps such as "claw", spiral or screw type pumps or pumps based on any other similar principle.

The vacuum pump 1 has one or more series-mounted pumping stages 2 in which a gas to be pumped circulates from an admission inlet to a delivery outlet (not shown). The rotary shafts 3 (only one can be seen in FIG. 1) extend into the pumping stage 2 by rotary lobe rotors 4 and are driven on the delivery stage side in a motor drive compartment 5 of the vacuum pump 1. The pumping stage 2 is said to be "dry" because during operation the rotors 4 rotate inside the casing 6 in opposite directions without any mechanical contact between the rotors 4 and the casing 6 of the vacuum pump 1, enabling a total absence of lubricant.

The vacuum pump works horizontally as shown in FIG. 1, i.e. during operation of the vacuum pump, the rotary shafts 3 are substantially parallel to the plane of the ground.

The rotary shafts 3 are supported at the end of the shaft by two lubricated support bearings (not visible), lubricated for example by grease at the suction stage, and two lubricated support bearings 7*a*, 7*b* of the motor drive compartment 5 on the delivery stage side, for example lubricated by a liquid lubricant such as oil. The lubricated support bearings 7*a*, 7*b* are provided with roller bearings 9 to guide and support the rotary shafts 3.

The vacuum pump 1 has a motor (not shown) housed in the motor drive compartment 5 as well as gears assemblies (not shown) mounted on the respective rotary shafts 3 to drive a driving shaft and a driven shaft in synchronous fashion.

The vacuum pump 1 has a first reservoir 28 comprising a first reserve of liquid lubricant 16*a*. The first reservoir 28 is in communication with the lubricated support bearing 7*a* in a first volume V1 (shown in dashes in FIG. 1).

The vacuum pump 1 also has a lubricant splashing unit 11 mounted on the drive rotary shaft 3 in the first reservoir 28, one end of the lubricant splashing unit 11 bathing in the first reserve of liquid lubricant 16*a*. The lubricant splashing unit 11 takes for example the form of a disk mounted coaxially with the rotary shaft 3. During operation, the rotation of the drive shaft 3 drives the rotation of the lubricant splashing unit 11, thus generating a mist of lubricant in the support bearings 7*a*, 7*b* which enables the lubrication of the roller bearings 9 of the vacuum pump 1.

The vacuum pump 1 furthermore comprises a device for sealing against lubricants to block the passage of lubricants from the motor drive compartment 5 to the pumping stages 2. The sealing device has a lubricant deflector 12 (FIGS. 1 and 5) and a ring seal 13 mounted on the respective rotary shaft 3, the ring seal 13 being mounted between the lubricant deflector 12 and the pumping stage 2 and the lubricant deflector 12 being mounted between the ring seal 13 and the lubricated support bearings 7*a*, 7*b*.

The ring seal 13 is for example a double-lip frictional ring seal.

Figure 5:
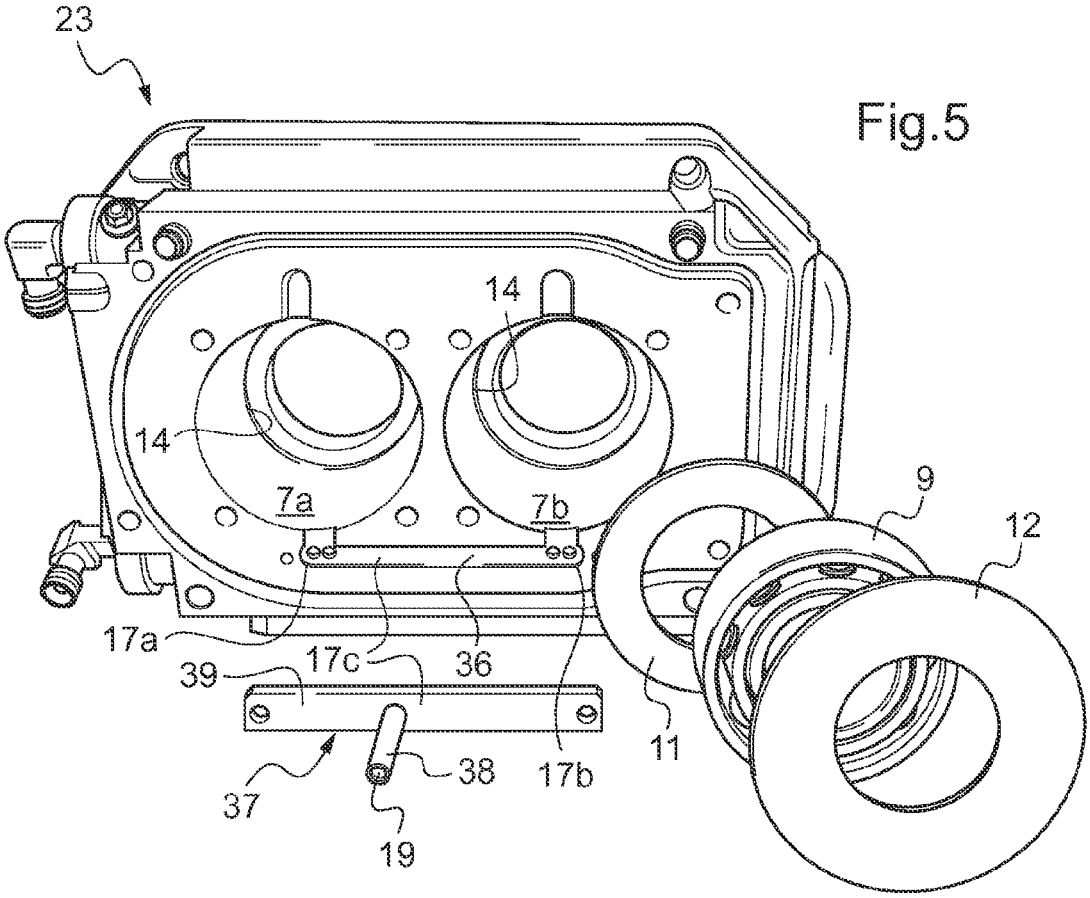
FIG. 5 is a view in perspective of the elements of the lubricated support bearing.
Figure 6:
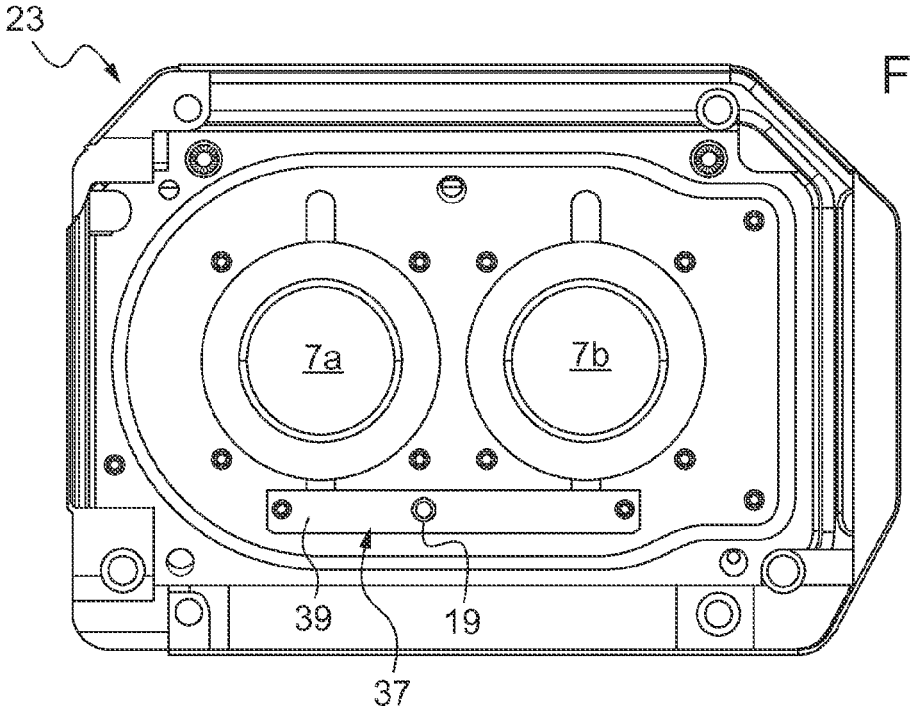
FIG. 6 is a schematic view of the elements of FIG. 5 in the assembled state.

The lubricant deflector 12 rotates connectedly with the rotational shaft 3, enabling the lubricant and the particles coming from the lubricated support bearings 7*a*, 7*b* to be diverted by centrifugation for example towards an annular groove 14 made in the body of the motor drive compartment 5 facing the peripheral end of the lubricant deflector 12 (see more specifically FIGS. 1 and 5). The lubricant deflector 12 takes for example the form of a disk mounted coaxially with the rotary shaft 3.

The vacuum pump 1 has a second reservoir 15 made in the casing 6 of the vacuum pump 1 comprising a second reserve of liquid lubricant 16*b* such as oil. The second reservoir 15 is separated from the first reservoir 28 by a separation wall 20 having a communication aperture 34 putting the first and second reserves of liquid lubricant 16*a*, 16*b* in communication. A lubricant return channel 17 of the vacuum pump 1 has an inlet 18 situated facing the lubricant deflector 12 for example in the annular groove 14. The lubricant return channel 17 extends in the housing of the body of the motor drive compartment 5 under the lubricated support bearings 7*a*, 7*b*, and leads through a opening 19 into the second volume V2 of the second reservoir 15, above the second reserve of lubricant fluid 16*b*.

During operation, the first volume V1 containing the lubricated support bearings 7*a*, 7*b* and the lubricant splashing unit 11 have an internal atmosphere that is misty with a mixture of gas and lubricant, generally oil-lubricated air, created especially by the rotation of the lubricant splashing unit 11. This atmosphere is separated by the separation wall 20 from the atmosphere of the second volume V2 of the second reservoir 15 into which the lubricant return channel 17 leads. Since the second reservoir 15 does not contain any lubricant splashing unit nor any rotational element in motion during the operation of the vacuum pump 1, it has a calm gas atmosphere above the liquid lubricant 16*b* without any lubricant mist, the liquid and gas phases being well separated from each other.

Thus, when the lubricant mist is drawn from the lubricated support bearings 7*a*, 7*b* to the pumping stage 2, the lubricant is deflected by the lubricant deflector 12 into the annular groove 14 and then into the lubricant return channel 17 by an effect of centrifugal force until it is poured into the second reserve of liquid lubricant 16*b* of the second reservoir 15.

And then during the pressure-balancing phases where the pressure in the lubricant support bearings 7*a*, 7*b* is greater than the pressure of the pumping stage 2, the liquid lubricant that has fallen to the bottom of the second reservoir 15 in the second reserve of liquid lubricant 16*b*, to a level lower than that of the opening 19 of the lubricant return channel 17, cannot rise in this channel. On the contrary, "dry" gas, i.e. lubricant-free gas, situated in the second reservoir 15 above the level of liquid lubricant will fill the lubricant return channel 17 and restore the equilibrium between the pressures on either side of the sealing device. The separation of the second reservoir 15 thus prevents the lubricant-misted air contained in the oily environment of the lubricated support bearings 7*a*, 7*b* in operation from entering the lubricant return channel 17.

To this end, and according to the embodiment shown in FIGS. 1 to 6, the casing of the motor drive compartment 5 comprises for example a drive stator 21, an oil casing 22 and an end flange 23 (or HP (high pressure) support) for example made of cast iron, assembled together, and a separation wall 20 separating the second volume V2 (filled with dots in FIG. 1) of the second reservoir 15 from the first volume V1 comprising the first reservoir 28 and the lubricated support bearings 7*a*, 7*b*.

Figure 2:
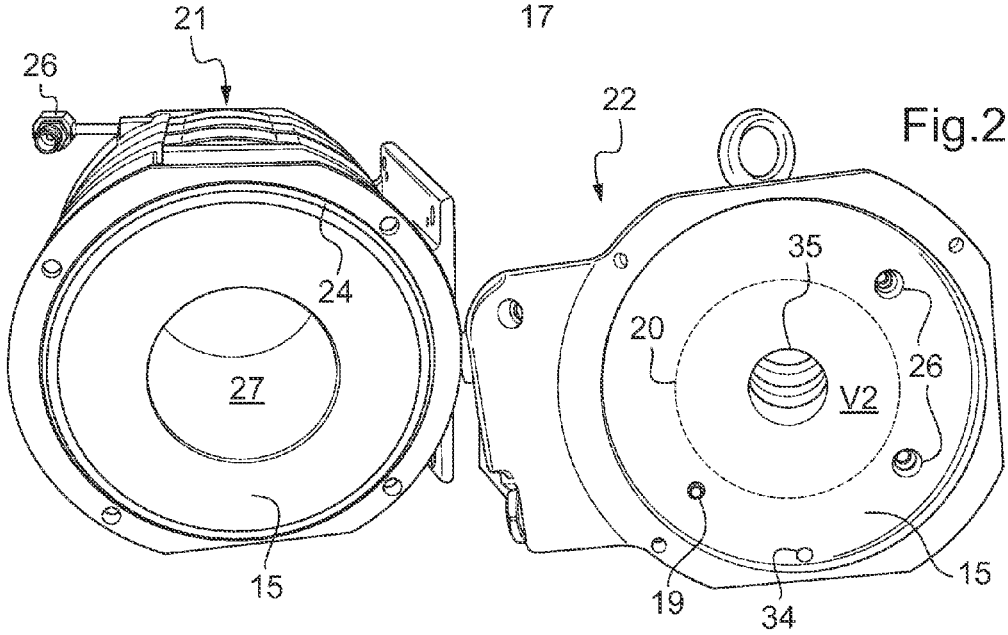
FIG. 2 is a view in perspective of the motor stator and of the oil casing (seen from the motor side) of the motor drive compartment of a vacuum pump in the disassembled state.

The separation wall 20, which is more visible in FIG. 2, is for example fixedly joined to the oil casing 22 which is assembled with the drive stator 21. The assembling of the drive stator 21 and of the oil casing 22 forms the second volume V2 having the second reserve of liquid lubricant 16*b* at the bottom. The assembling is done conventionally with an O-ring 24 and fastening means. The drive stator 21 furthermore has means 26 for cooling the motor with refrigerant. These means are partly concealed by a resin in which an axial housing 27 is made in the rotational axis of the drive shaft to house the drive rotor (not shown).

Figure 3:
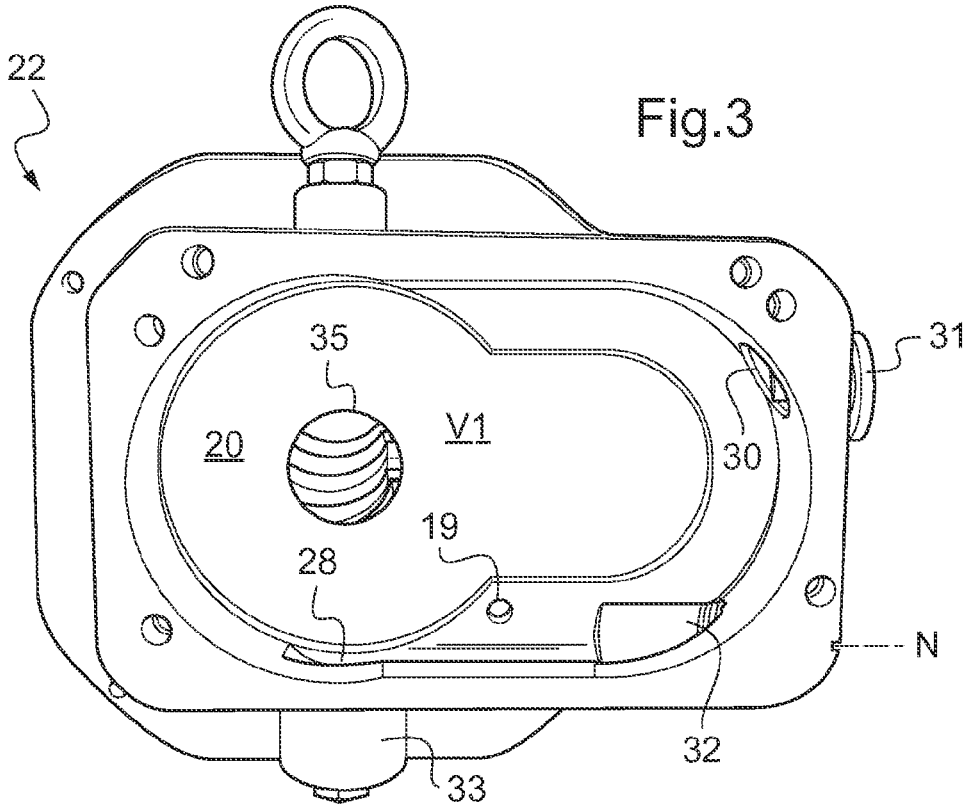
FIG. 3 is a back view of the oil casing of FIG. 2 (seen from the gear side)
Figure 4:
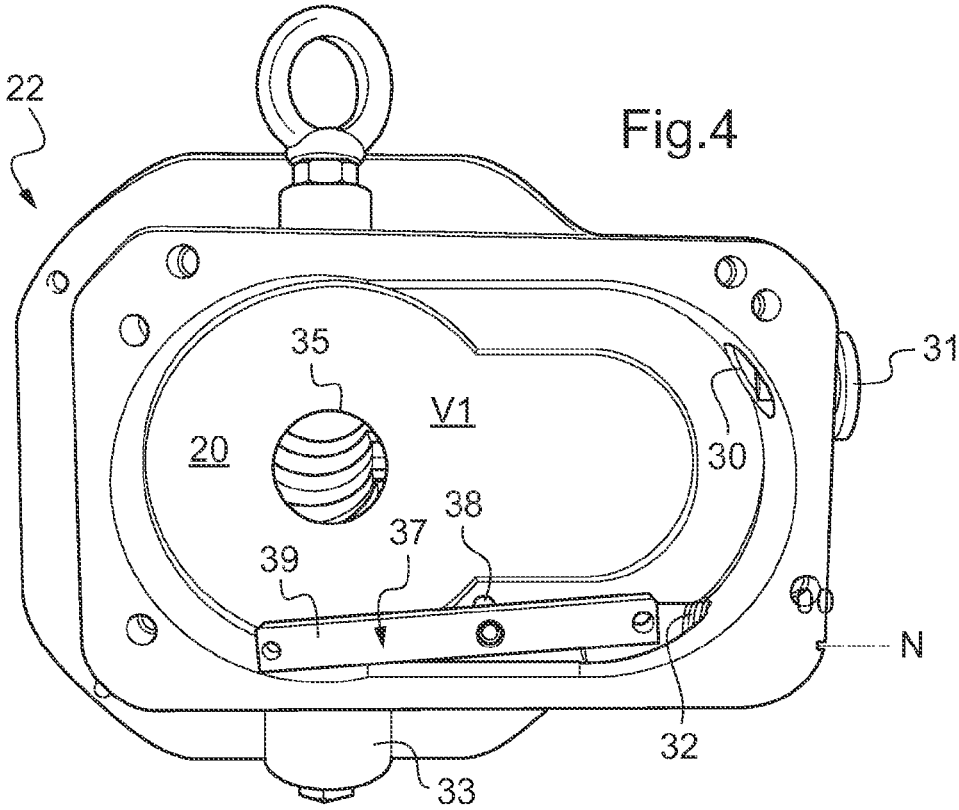
FIG. 4 is a similar view of the oil casing seen from the gear side of FIG. 3 in which a connection element is placed.

The bottom of the first volume V1 formed by the oil casing 22 and the end flange 23 assembled together comprise the first reserve of liquid lubricant 16*a* to lubricate the rotational elements of the lubricated support bearings 7*a*, 7*b* (FIGS. 3 and 5).

FIG. 3 shows a filling hole 30 on the back of the oil casing 22. This filling hole 30 can be seen at the top right-hand corner of the oil casing, communicating with the first volume V1. The filling hole 30 is blocked with a plug 31. A reference marking can also be seen at the bottom right-hand corner of the oil casing 22 indicating the set level N of liquid lubricant. This reference marking corresponds to a transparent portion of the oil casing 22 made on the edge (not visible in FIG. 3) to guide the user in filling with liquid lubricant 16*a* to the set level N. The oil casing 22 also has a draining hole 32 blocked and communicating with the bottom 28 and a blocked vessel part 33 for the emptying the vacuum pump 1.

As can be seen in FIG. 2, the separation wall 20 has a communication aperture 34 beneath the set level N of liquid lubricant in order to level up the lubricant liquids of the first and second reserves of liquid lubricant 16*a*, 16*b*. The communication aperture 34 is therefore situated beneath the opening 19 of the lubricant fluid return channel 17. The invention thus makes sure of the level of liquid lubricant of the second reserve 16*b* at the same time as the level of liquid lubricant of the first reserve 16*a* through the means for filling, draining and emptying the oil casing 22.

Besides, the conductance of the shaft passage 35 in the separation wall and the conductance of the opening 19 of the lubricant return channel 17 are calibrated to direct a gas stream into the lubricant return channel 17 from the second volume V2 to the lubricant deflector 12.

With this calibration of the conductance values, when the pressure drops in the pumping stage 2, it drops faster in the first volume V1 comprising the lubricated stages 7*a*, 7*b* than in the second volume V2 of the second reservoir 15. The second volume V2 then keeps a slight excess pressure of about 2 bars relatively to the first volume V1. The dry gas will then rush through the lubricant return channel 17 and get accelerated therein up to the inlet 18 of the lubricant return channel 17, forming a barrier of dry gas at the lubricant deflector 12. Thus, an acceleration of the gas stream is encouraged in the lubricant return channel 17 from the second volume V2 to the lubricant deflector 12 rather than from the first volume V1 to the second volume V2.

The conductance between the first volume V1 and the second volume V2 is defined by the space made between the drive shaft 3 and the shaft passage 35 in the separation wall 20. It is provided for example that the gap between the diameter of the shaft passage 35 and the diameter of the rotary shaft 3 will be smaller than 3 millimeters, preferably of the order of 2 millimeters. And it can also be provided that the size of the internal diameter of the opening 19 of the lubricant return channel 17 will be smaller than 5 millimeters, preferably of the order of 4 millimeters.

Thus, the small space at the level of the shaft passage 35 favors excess pressure in the second volume V2 as compared with the first volume V1 and the low conductance of the lubricant return channel 17 favors the acceleration of dry gas in the lubricant fluid return channel 17, thus enabling the formation of the gas barrier at the lubricant deflector 12.

It can furthermore be planned that the lubricant return channel 17 will comprise a first channel portion 17*a* associated with the first lubricated support bearing 7*a*, a second channel portion 17*b* associated with the second lubricated support bearing 7*b*, and a channel portion 17*c* common to the first and second channel portions 17*a*, 17*b*. Each channel portion 17*a* and 17*b* has an inlet situated in the annular groove 14 facing the lubricant deflector 12 associated with the respective lubricated support bearings 7*a*, 7*b*. The lubricant fluid return channel 17 thus communicates between the first and the second lubricated support bearings 7*a*, 7*b* in order to preserve an equilibrium of lubricant in the two lubricated support bearings 7*a*, 7*b*.

To this end, and as can be seen in FIG. 5, the lubricant return channel 17 has a communicating groove 36 between the first channel portion 17*a* and the second channel portion 17*b*. The lubricant return channel 17 furthermore has a connection element 37 that gets assembled with the communicating groove 36 and opens into a junction tube 38. Once the connecting element 37 is joined between the oil casing 22 and the end flange 23, the junction tube 38 opens from the separation wall 20 into the second volume V2 through the opening 19.

The connection element 37 comprises for example a plate 39 closing the communicating groove 36 and a junction tube 38 off-centered from the middle of the plate 39 projecting perpendicularly from the plate 39. The junction tube 38 is off-centered to enable the rotation of the rotary elements such as the lubricant splashing unit 11 of the lubricated support bearing 7*a* of the drive shaft 3.

The migration of the lubricant to the sealing device through the lubricant return channel 17 and through the lubricated support bearings 7*a*, 7*b* is thus limited in making sure that the lubricant does not bypass the lubricated support bearings 7*a*, 7*b* of the motor drive compartment 5 to directly reach the ring seal 13 without being processed by the lubricant deflector 12, and this increasing the service life of the ring seal 13.

Although a description has been given of a sealing device and of liquid lubricant reservoirs positioned on the vacuum pump delivery side, the sealing device and the liquid lubricant reservoirs could equally well be laid out on the suction or intake side, at the end of the stage with the lowest pressure, as a replacement for lubrication by grease.

The invention claimed is:

1. Dry-type vacuum pump comprising:

at least one pumping stage, at least one rotary shaft supported by a lubricated support bearing, at least one lubricant deflector and one ring seal mounted on the rotary shaft, the ring seal being mounted between the lubricant deflector and the pumping stage, the lubricant deflector being mounted between the lubricated support bearing and the ring seal, a first reservoir containing a first reserve of liquid lubricant, said first reservoir being in communication with the lubricated support bearing in a first volume, a lubricant splashing unit mounted on the rotary shaft in the first reservoir, one end of the lubricant splashing unit being bathed in the first reserve of liquid lubricant, wherein the vacuum pump has a second reservoir comprising a second reserve of liquid lubricant, the second reservoir being separated from the first reservoir by a separation wall having a communication aperture that puts the first and the second reserves of liquid lubricant into communication and wherein a lubricant return channel having one inlet situated so as to be facing said lubricant deflector opens into a second volume of the second reservoir above the second reserve of liquid lubricant through an opening.

2. Vacuum pump according to claim 1, wherein the second reservoir and said lubricant return channel are made in the casing of a motor drive compartment of said vacuum pump.

3. Vacuum pump according to claim 1, wherein a size of the internal diameter of the opening of the lubricant return channel is smaller than 5 millimeters.

4. Vacuum pump according to claim 1, wherein a gap between a diameter of the shaft passage in the separation wall and a diameter of the rotary shaft is smaller than three millimeters.

5. Vacuum pump according to claim 1, wherein an annular groove is made in the casing in front of a peripheral end of the lubricant deflector and communicates with the inlet of said lubricant return channel.

6. Vacuum pump according to claim 1, comprising two rotary shafts, said rotary shafts being each supported by a respective lubricated support bearing and wherein said lubricant return channel comprises a first channel portion associated with a first lubricated support bearing, a second channel portion associated with a second lubricant support bearing and a channel portion common to said first and second channel portions.

7. Vacuum pump according to claim 6, wherein the lubricant return channel has a communicating groove between said first channel portion and said second channel portion and said lubricant return channel comprises a connection element that gets joined with said communicating groove and opens into a junction tube.

8. Vacuum pump according to claim 7, wherein said connection element comprises a plate closing said communicating groove and an off-centered junction tube projecting perpendicularly from said plate.

* * * * *